US006371893B1

(12) United States Patent
Redden

(10) Patent No.: US 6,371,893 B1
(45) Date of Patent: Apr. 16, 2002

(54) BODY SUPPORTED BARBELL CARRYING DEVICE

(76) Inventor: Dallas L. Redden, 319 Cimarron St., Lake Elmo, MN (US) 55042

( * ) Notice: Subject to any disclaimer, the term of this patent is extended or adjusted under 35 U.S.C. 154(b) by 0 days.

(21) Appl. No.: 09/502,302

(22) Filed: Feb. 11, 2000

(51) Int. Cl.[7] ..... A63B 21/65; A63B 21/72

(52) U.S. Cl. ..... 482/105; 482/104; 482/106

(58) Field of Search ..... 482/105–108, 482/139, 104; 224/185, 197, 200, 201

(56) References Cited

U.S. PATENT DOCUMENTS

| | | | | | |
|---|---|---|---|---|---|
| 1,291,465 | A | * | 1/1919 | Foreman | 482/105 |
| 2,506,685 | A | * | 5/1950 | Sadloski et al. | 224/185 |
| 3,273,766 | A | * | 9/1966 | Cosenting | 224/197 |
| 3,322,425 | A | * | 5/1967 | Moore | 482/105 |
| 3,370,850 | A | * | 2/1968 | Moore | 482/105 |
| 3,679,107 | A | * | 7/1972 | Perrine | 482/106 |
| 4,213,605 | A | | 7/1980 | Mc Peak | |
| 4,722,524 | A | * | 2/1988 | Waszkelewicz | 482/106 |
| 4,986,536 | A | * | 1/1991 | Zane | 482/106 |
| 5,058,886 | A | * | 10/1991 | Jackson | 482/106 |
| 5,118,100 | A | | 6/1992 | Sungaila | |
| 5,169,364 | A | | 12/1992 | Donaldson | |
| 5,211,615 | A | | 5/1993 | Sides | |
| 5,342,272 | A | * | 8/1994 | Pittroff | 482/106 |
| 5,472,398 | A | * | 12/1995 | Silverman | 482/105 |
| 5,593,145 | A | * | 1/1997 | Sprayberry | 224/265 |
| D381,516 | S | | 7/1997 | Andryzeck et al. | |
| 5,846,169 | A | * | 12/1998 | Tscheschlog | 482/105 |
| 5,957,818 | A | * | 9/1999 | Betournay | 482/105 |
| 6,135,932 | A | * | 10/2000 | Pittroff | 482/106 |

* cited by examiner

*Primary Examiner*—Michael A. Brown
*Assistant Examiner*—Victor Hwang

(57) ABSTRACT

A body supported carrying device for increasing the comfort for the weightlifter. The body supported carrying device includes a pair of body supported carrying members each of which includes a base member which is an inverted U-shaped structure and which has an inner side and a pair of spaced extended portions, and which further includes a padded member securely attached to the inner side between the extended portions, and which also includes a weight-lifting bar support member which includes a stub shaft which is pivotally mounted in a top of the base member and which has a longitudinal slot extending through a second end of the stub shaft. The slot is adapted to receive a portion of a weight-lifting bar and the extended portions of the U-shaped structure is adapted to fit about a user's legs and shoulders.

6 Claims, 2 Drawing Sheets

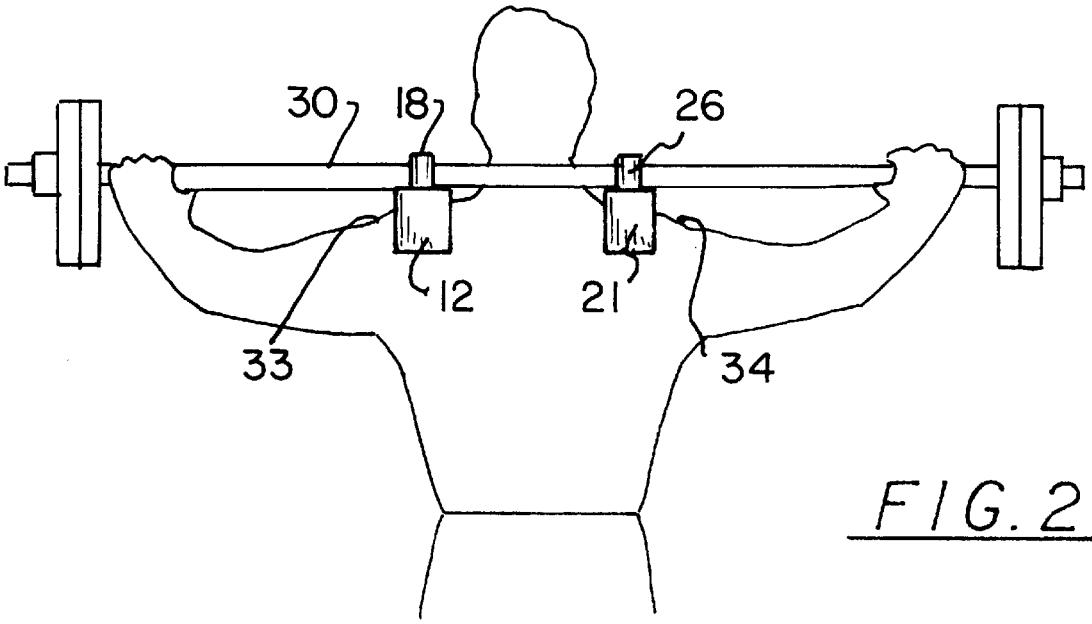
FIG. 2
FIG. 3
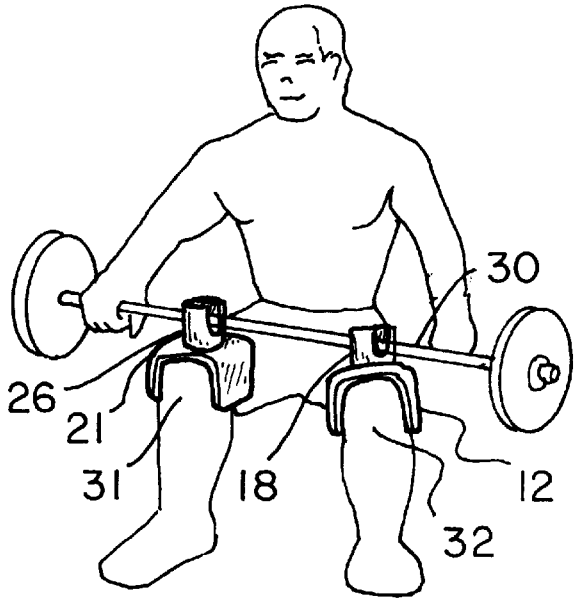

BODY SUPPORTED BARBELL CARRYING DEVICE

BACKGROUND OF THE INVENTION

1. Field of the Invention

The present invention relates to a barbell support device for one's body and more particularly pertains to a new body supported carrying device for increasing the comfort for the weightlifter.

2. Description of the Prior Art

The use of a barbell support device for one's body is known in the prior art. More specifically, a barbell support device for one's body heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,215,605; 5,169,364; 5,211,615; 3,322,425; U.S. Pat. No. Des. 381,516; and U.S. Pat. No. 5,118,100.

While these devices fulfill their respective, particular objectives and requirements, the aforementioned patents do not disclose a new body supported carrying device. The inventive device includes a pair of body supported carrying members each of which includes a base member which is an inverted U-shaped structure and which has an inner side and a pair of spaced extended portions, and which further includes a padded member securely attached to the inner side between the extended portions, and which also includes a weight-lifting bar support member which includes a stub shaft which is pivotally mounted in a top of the base member and which has a longitudinal slot extending through a second end of the stub shaft. The slot is adapted to receive a portion of a weightlifting bar and the extended portions of the U-shaped structure is adapted to fit about a user's legs and shoulders.

In these respects, the body supported carrying device according to the present invention substantially departs from the conventional concepts and designs of the prior art, and in so doing provides an apparatus primarily developed for the purpose of increasing the comfort for the weightlifter.

SUMMARY OF THE INVENTION

In view of the foregoing disadvantages inherent in the known types of a barbell support device for one's body now present in the prior art, the present invention provides a new body supported carrying device construction wherein the same can be utilized for increasing the comfort for the weightlifter.

The general purpose of the present invention, which will be described subsequently in greater detail, is to provide a new body supported carrying device apparatus and method which has many of the advantages of the a barbell support device for one's body mentioned heretofore and many novel features that result in a new body supported carrying device which is not anticipated, rendered obvious, suggested, or even implied by any of the prior art a barbell support device for one's body, either alone or in any combination thereof.

To attain this, the present invention generally comprises a pair of body supported carrying members each of which includes a base member which is an inverted U-shaped structure and which has an inner side and a pair of spaced extended portions, and which further includes a padded member securely attached to the inner side between the extended portions, and which also includes a weight-lifting bar support member which includes a stub shaft which is pivotally mounted in a top of the base member and which has a longitudinal slot extending through a second end of the stub shaft. The slot is adapted to receive a portion of a weight-lifting bar and the extended portions of the U-shaped structure is adapted to fit about a user's legs and shoulders.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new body supported carrying device apparatus and method which has many of the advantages of the a barbell support device for one's body mentioned heretofore and many novel features that result in a new body supported carrying device which is not anticipated, rendered obvious, suggested, or even implied by any of the prior art a barbell support device for one's body, either alone or in any combination thereof.

It is another object of the present invention to provide a new body supported carrying device which may be easily and efficiently manufactured and marketed.

It is a further object of the present invention to provide a new body supported carrying device which is of a durable and reliable construction.

An even further object of the present invention is to provide a new body supported carrying device which is susceptible of a low cost of manufacture with regard to both materials and labor, and which accordingly is then susceptible of low prices of sale to the consuming public, thereby making such body supported carrying device economically available to the buying public.

Still yet another object of the present invention is to provide a new body supported carrying device which provides in the apparatuses and methods of the prior art some of the advantages thereof, while simultaneously overcoming some of the disadvantages normally associated therewith.

Still another object of the present invention is to provide a new body supported carrying device for increasing the comfort for the weightlifter.

Yet another object of the present invention is to provide a new body supported carrying device which includes a pair of body supported carrying members each of which includes a base member which is an inverted U-shaped structure and which has an inner side and a pair of spaced extended portions, and which further includes a padded member securely attached to the inner side between the extended portions, and which also includes a weight-lifting bar support member which includes a stub shaft which is pivotally mounted in a top of the base member and which has a longitudinal slot extending through a second end of the stub shaft. The slot is adapted to receive a portion of a weight-lifting bar and the extended portions of the U-shaped structure is adapted to fit about a user's legs and shoulders.

Still yet another object of the present invention is to provide a new body supported carrying device that essentially allows the user to safely do exercises with a barbell without worrying about the barbell falling.

Even still another object of the present invention is to provide a new body supported carrying device that substantially reduces the amount strain placed on the user's body when exercising with a barbell.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevational view of the present invention being used upon a user's shoulders.

FIG. 3 is a perspective view of the present invention being used upon a user's legs.

DESCRIPTION OF THE PREFERRED EMBODIMENT

Figure 1:
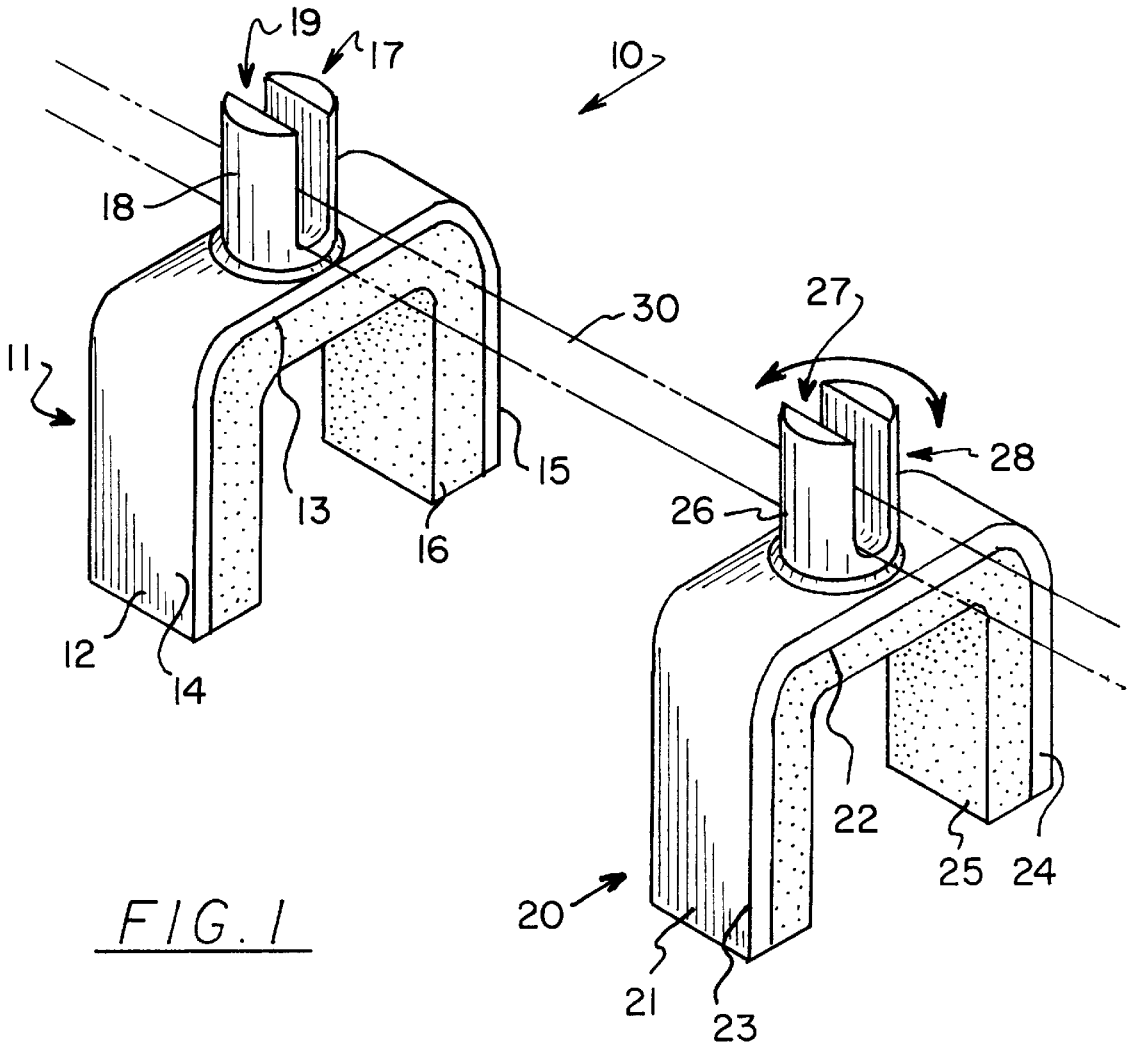
FIG. 1 is a perspective view of a new body supported carrying device according to the present invention.

With reference now to the drawings, and in particular to FIGS. 1 through 3 thereof, a new body supported carrying device embodying the principles and concepts of the present invention and generally designated by the reference numeral 10 will be described.

As best illustrated in FIGS. 1 through 3, the body supported carrying device 10 generally comprises a pair of body supported carrying members 11,20 each of which is adapted to fit over a user's legs 31,32 and shoulders 33,34 and each of which includes a base member 12,21, a padded member 16,25 securely attached and glued to the base member 12,21, and a weight-lifting bar support member 17,28 which is pivotally mounted to a top of the base member 12,21 and extending outwardly therefrom. The base member 12,21 is essentially an inverted U-shaped structure having an inner side 13,22 and including a pair of spaced extended portions 14,15,23,24. The padded member 16,25 is securely attached to the inner side 13,22 of the inverted U-shaped structure between the extended portions 14,15,23,24. The extended portions 14,15,23,24 are adapted to fit about a user's leg 31,32 and about a user's shoulders 33,34. The weight-lifting bar support member 17,28 includes a stub shaft 18,26 having a first end pivotally and conventionally supported and extended in a top of the base member 12,21. The stub shaft 18,26 further has a longitudinal slot 19,27 extending through a second end thereof and terminating near the first end. The slot 19,27 is adapted to receive a portion of a weight-lifting bar 30.

In use, the user places the body supported carrying members 11,20 over one's legs 31,32 above the knees and places portions of the weight-lifting bar 30 in the slots 19,27 of the stub shafts 18,26 to support the barbells and to facilitate calf exercises. In addition, the user can place the body supported carrying members 11,20 over one's shoulders 33,34 to support a barbell thereupon in order to facilitate squatting exercises.

As further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body supported barbell carrying device comprising:

a pair of body supported carrying members each of which is adapted to fit over a user's legs and shoulders and each of which includes a base member, a padded member securely attached to said base member, and a weight-lifting bar support member which is pivotally mounted to a top of said base member and extending outwardly therefrom wherein said weight-lifting bar support member includes a stub shaft having a first end pivotally supported and extended in a top of said base member, said stub shaft further having a longitudinal slot extending through a second end thereof and terminating near said first end, said slot being adapted to receive a portion of a weight-lifting bar of a barbell.

2. A body supported carrying device as described in claim 1, wherein said base member is essentially an inverted U-shaped structure having an inner side.

3. A body supported carrying device as described in claim 2, wherein said inverted U-shaped structure includes a pair of spaced extended portions.

4. A body supported carrying device as described in claim 3, wherein said padded member is securely attached to said inner side of said inverted U-shaped structure between said extended portions.

5. A body supported carrying device as described in claim 4, wherein said extended portions are adapted to fit about a user's leg and about a user's shoulders.

6. A body supported barbell carrying device comprising:

a pair of body supported carrying members each of which is adapted to fit over a user's legs and shoulders and each of which includes a base member, a padded member securely attached to said base member, and a weight-lifting bar support member which is pivotally mounted to a top of said base member and extending outwardly therefrom, said base member being essentially an inverted U-shaped structure having an inner side, said inverted U-shaped structure including a pair of spaced extended portions, said padded member being securely attached to said inner side of said inverted U-shaped structure between said extended portions, said extended portions being adapted to fit about a user's leg and about a user's shoulders, said weight-lifting bar support member including a stub shaft having a first end pivotally supported and extended in a top of said base member, said stub shaft further having a longitudinal slot extending through a second end thereof and terminating near said first end, said slot being adapted to receive a portion of a weight-lifting bar.

* * * * *